US012215446B2

(12) United States Patent
Vicerial et al.

(10) Patent No.: US 12,215,446 B2
(45) Date of Patent: Feb. 4, 2025

(54) METHOD OF WEAVING TEXTILE ARTICLES, AND DEVICE FOR CARRYING OUT SAID METHOD

(71) Applicants: PARIS SCIENCES ET LETTRES, Paris (FR); ECOLE NATIONALE SUPERIEURE DES ARTS DECORATIFS, Paris (FR); ECOLE NATIONALE SUPERIEURE DES MINES DE PARIS, Paris (FR)

(72) Inventors: Jeanne Vicerial, Pantin (FR); Aurélie Mosse, Paris (FR); Jean-François Bassereau, Paris (FR); Philippe Faul, L'Isle Adam (FR); Yvon Gaignebet, L'Hay les Roses (FR)

(73) Assignees: PARIS SCIENCES ET LETTRES, Paris (FR); ECOLE NATIONALE SUPERIEURE DES ARTS DECORATIFS, Paris (FR); ECOLE NATIONALE SUPERIEURE DES MINES DE PARIS, Paris (FR)

( * ) Notice: Subject to any disclaimer, the term of this patent is extended or adjusted under 35 U.S.C. 154(b) by 650 days.

(21) Appl. No.: 17/419,663

(22) PCT Filed: Dec. 19, 2019

(86) PCT No.: PCT/FR2019/053218
§ 371 (c)(1),
(2) Date: Jun. 29, 2021

(87) PCT Pub. No.: WO2020/141271
PCT Pub. Date: Jul. 9, 2020

(65) Prior Publication Data

US 2022/0074088 A1 Mar. 10, 2022

(30) Foreign Application Priority Data

Dec. 31, 2018 (FR) ..... 1874416

(51) Int. Cl.
*D03D 41/00* (2006.01)
*D03D 25/00* (2006.01)

(52) U.S. Cl.
CPC ..... *D03D 41/00* (2013.01); *D03D 25/00* (2013.01); *D03D 25/005* (2013.01); *D03D 41/004* (2013.01)

(58) Field of Classification Search
CPC ..... D03D 25/00; D03D 25/005; D03D 41/00; D03D 41/004; B29C 70/22; B29C 70/24;
(Continued)

(56) References Cited

U.S. PATENT DOCUMENTS 662,963 A * 12/1900 Preston et al. ..... B60C 9/023 156/181
2,150,937 A * 3/1939 Novak ..... F16D 69/022 428/292.1

(Continued)

FOREIGN PATENT DOCUMENTS

DE 30 03 666 8/1981
DE 20 2017 103 295 7/2017

(Continued)

OTHER PUBLICATIONS

Search Report for FR Application No. 1874416 dated Nov. 13, 2019, 2 pages.

(Continued)

*Primary Examiner* — Shaun R Hurley
(74) *Attorney, Agent, or Firm* — NIXON & VANDERHYE

(57) ABSTRACT

Disclosed is a method of manufacturing a textile article from a continuous thread-type element, a device for manufacturing said textile article, and a textile article obtained by such method.

14 Claims, 7 Drawing Sheets

(58) Field of Classification Search
CPC ... D04H 3/02; D04H 3/05; Y10T 428/249924
USPC ..... 19/296, 299; 156/181
See application file for complete search history.

(56) References Cited

U.S. PATENT DOCUMENTS 3,039,169 A * 6/1962 Frickert, Jr. ..... D04H 3/02 28/100
3,399,642 A * 9/1968 Etchison ..... A41D 27/24 112/420
3,607,564 A * 9/1971 Rasko ..... D04H 3/14 156/181
4,080,232 A * 3/1978 Friedrich ..... D04H 3/045 156/181
4,546,497 A * 10/1985 Ono ..... A41D 13/008 139/420 R
4,557,790 A * 12/1985 Wisbey ..... B29C 70/388 156/519
4,715,924 A * 12/1987 McConnell ..... B29C 70/382 156/181
4,774,108 A * 9/1988 Cano ..... D04H 3/02 427/282
RE33,418 E * 11/1990 Krueger ..... B29C 70/16 156/181
4,976,012 A * 12/1990 McConnell ..... B29C 70/22 156/181
5,558,738 A * 9/1996 Rector ..... D04H 3/05 156/169
2003/0196743 A1* 10/2003 Borbone ..... B29C 70/382 156/441
2004/0244859 A1* 12/2004 Kern ..... D03D 41/004 139/2
2006/0048262 A1* 3/2006 Sencion ..... A41D 15/00 2/69
2006/0090314 A1* 5/2006 Delecroix ..... F16D 69/023 28/100
2006/0213094 A1* 9/2006 Uchimura ..... D06M 15/507 38/144
2016/0257081 A1* 9/2016 Butcher ..... B29C 70/541

FOREIGN PATENT DOCUMENTS

EP 0 591 822 4/1994
FR 2764311 A1 * 12/1998 ..... B29C 53/564

OTHER PUBLICATIONS

International Search Report for PCT/FR2019/053218 dated May 8, 2020, 5 pages.
Written Opinion of the ISA for PCT/FR2019/053218 dated May 8, 2020, 7 pages.

* cited by examiner woven piece of textile n°1 & 2

METHOD OF WEAVING TEXTILE ARTICLES, AND DEVICE FOR CARRYING OUT SAID METHOD

This application is the U.S. national phase of International Application No. PCT/FR2019/053218 filed Dec. 19, 2019 which designated the U.S. and claims priority to FR Patent Application No. 18/74416 filed Dec. 31, 2018, the entire contents of each of which are hereby incorporated by reference.

The invention relates generally to the field of weaving.

More particularly, the present invention relates to a device for the manufacture of a textile article from a continuous thread-type element, to a method for the manufacture of said textile article and to a textile article obtained by said method.

The conventional textile industry is based on the mass production of articles which are woven, cut and then put together according to known methods.

In this manufacturing method, the design of the textile generally does not take into account the (three-dimensional) silhouette of the g arment or the intent of the garment or the expectation of customers.

As such, textile design and fashion design are currently separate from each other.

Of course, tailor-made craftsmanship still exists. The traditional stages of making a made-to-measure garment are: the pattern which consists in making the designs of a garment, the cutting of the fabric which consists in cutting out all the pieces of the pattern and the assembly which consists in assembling the different pieces of fabric that are sewn.

However, the manufacture of a made-to-measure garment is generally associated with expensive raw materials and a high production cost due to the time spent in making it and also to the many scraps of fabric.

The present invention aims to overcome the drawbacks of traditional methods and devices for making a made-to-measure garment by proposing a new semi-automatic or automatic process for making a made-to-measure garment without scraps of fabric.

The present invention aims in particular to simplify the manufacture of a made-to-measure garment and thus to educe its cost by proposing a method for mechatronically producing a textile or fabric with an openwork structure from a continuous thread. Said manufacturing method is implemented using a new weaving device.

For the purpose of the present invention, the weaving method corresponds to a technique using the interweaving of a continuous thread.

For the purpose of the present invention, the term "thread-type element" is understood to mean a thread chosen from the group consisting of a polyester, wool, cotton, pearl cotton, embroidery scottish cotton, nylon, natural or synthetic raffia, string, more generally any thread of any kind that accepts tensioning, for example any thread used in knitting and textile weaving, including technical threads used in components with high mechanical performance, including geotextile.

For the purpose of the present invention, the term "segment of thread-type element" means the part of the thread-type element between two winding segments.

For the purpose of the present invention, the term "winding segment" is understood to mean any means positioned vertically on a support allowing the winding of a thread-type element.

The winding segments are chosen from the group consisting of pins, pawns, solid or hollow rods.

The first object of the present invention is therefore a weaving device for the manufacture of a piece of a textile article from a continuous thread element, said device comprising:

- a support (1),
- winding segments (2),
- a means (3) suitable for positioning or removing winding segments on the support according to the outline of a shape to be manufactured corresponding to the pattern of the textile article,
- a means (4) suitable for delivering and winding the thread-type element around the winding segments,
- a supply of thread-type element,
- mechanical electronic means (5) for moving the means (3) and (4) in three dimensions along the axes "X", "Y" and "Z" in a system of rectangular coordinates as well as on 2 axes of alpha and beta rotations in an angular system according to a predetermined sequence and pattern,
- optionally a base for one or more coil(s) of a thread-type element (9),
- a control system comprising software controlling the movement of the means (3) and (4) allowing to arrange the winding segments on the support, and to carry out the winding of the thread-type element around of said winding segments.

According to a particular embodiment of the invention, the means suitable for positioning or removing winding segments on the support is a head for planting/gripping the removable or retractable winding segments (3) provided with a planting clamp/gripper of the winding segments.

The means (3) also comprises a linear actuator provided with a mechanism with 3 degrees of freedom for moving the planting/gripping head in three dimensions along the axes "X", "Y" and "Z" in a system of rectangular coordinates and also along 2 angular axes alpha and beta to orient and position the winding segments.

According to a particular embodiment of the invention, the means (4) suitable for delivering and winding the thread-type element around the winding segments is a removable or retractable distribution head (4) adjustable in height provided with an outlet of the thread-type element.

According to a particular embodiment of the invention, the outlet of the thread-type element is in the form of a tube.

The device according to the present invention further comprises

- tension regulation means (8) of the thread-type element (9),

According to a particular embodiment of the invention, the thread-type element is blocked on a first winding segment then the tension of the thread-type element is ensured by a tension block upstream of the distribution head (4) of the thread-type element.

According to a particular embodiment of the invention, the tension of the thread-type element is maintained thanks to the tension system during the movement of the distribution head (4) of the thread-type element.

The tension of the thread-type element is constant from the last crossing point to the tension block.

The device for varying the length and/or tension of the thread-type element of the present invention comprises a sensor allowing a measurement of tension, a control unit and a block for varying the length and/or tension allowing unwinding under tension of the thread-type element. The tension sensor is placed between the tension block and the tip located at the end of the tube of the thread-type element of the distribution head of the thread-type element to measure and/or adjust with the help of the control block, the tension of the thread-type element as a function of the weaving zone defined by the man skilled in the art.

The device according to the present invention comprises a support suitable for receiving the winding segments.

Generally, the support is in the form of a frame (13) the orientation of which is adjustable through 90° to provide a working surface vertically or horizontally or inclined relative to the ground.

According to a particular embodiment of the invention, the support is in the form of a frame with a length of 200 to 100 cm and a width of 150 to 80 cm, preferably a frame of 120×90 cm, 150×90 cm or 180×90 cm.

According to a particular embodiment of the invention, the support is in the form of a table the horizontal support of which is at a height from the ground of 75 to 95 cm, or the vertical support of which has a base at a height from the ground of 60 to 80 cm.

According to a particular embodiment of the invention, the support comprises or consists of one or more layer(s), of one or more material(s). More particularly, the support comprises or consists of a cork or shape memory or foam part.

According to a particular embodiment of the invention, the support further comprises a grid or a graph provided with marks or holes useful for the identification and positioning of the winding segments on said support.

According to a particular embodiment of the invention, the support optionally comprises openings/orifices placed in the upper part of said support to allow the passage or the placement of the winding segments.

According to another particular embodiment of the invention, the support comprises or consists of a flat surface or comprises convex surfaces produced by series of intersecting profiles. These profiles have cutouts. By varying the profiles in orientation and distance, it is thus possible to reproduce a large number of surfaces that are always convex, satisfying the objective of tensioning and shaping the thread, other than during a course of the thread on the flat surface of the initial support.

The convex surface is obtained by this network of intersecting profiles, preferably at 90°, which are fixed at their bases on the flat surface of the initial support.

The term "profile" can refer to the vocabulary of an aerodynamic element, comprising a rounded leading edge, a maximum thickness placed towards the front third, and a thin trailing edge on the rear. The distance from the leading edge to the trailing edge is called the chord.

A profile according to the invention refers for example to the following shapes: an airplane wing, a sail of a ship, a blade of a boomerang, a fin, a keel, a rudder of a sailboat, a propeller of an airplane, a rotor of a helicopter.

Each profile may vary in cut. It meets, perpendicularly, every 5 to 10 cm another profile. The height can vary throughout the profile but remains similar to the crossing between two profiles.

It is thus advantageous to have a set of profiles allowing the construction of a wide variety of totally or partially convex surface shapes.

For example, a repetition of intersection of symmetrical profiles can constitute a wing as shown in FIG. 5. Profiles can also be flat, hollow, multi-curved and asymmetrical.

At the top of the convex surface made up of the network of profiles, preferably a meshed reference will be made to a rounding as a soft transition, replacing a simple edge between two surfaces (two plans) and having a piece in an arc of a circle or substantially in an arc of a circle.

At the base of the all or part convex shape, we will favor a concave piece for the conge, to prevent any impact and contact with the coil of the thread-type element.

The term "congé or hollow moulding" refers to the pattern marking the end of an arcuate molding path used to soften the contours of a piece of woodworking.

According to the present invention the term "congé" is used to characterize the shape of a base of a profile.

According to the present invention, the man skilled in the art can also use the term "chamfer", which is a particular congé, constituting a small oblique, flat and regular surface, which is obtained by cutting down a sharp edge.

Its value can be quantified by giving its inclination and its width: we say for example "cut the edges with a chamfer of 3 mm at 45°".

According to another particular embodiment of the invention, the support comprises or consists of at least one three-dimensional zone, preferably a convex zone.

A man skilled in the art understands that the support of the device of the invention is adaptable and is plan to allow the manufacture of two-dimensional pieces, or is plan and comprises one or more non-plan zone(s), preferably convex, or consists of one or more non-plan zone(s), preferably convex to allow the manufacture of one or more textile article pieces(s) forming a three-dimensional article.

According to another particular embodiment of the invention, the support comprises a frame (13) resting on the support. The frame is preferably made up of linear slides which may include linear guide units made up of a rail-carriage system, a linear bearing/shaft system, or a rail-rail system with intermediate linear cages with rollers or balls.

Linear guide units with drive are complete single or multi-axis systems with mechanical guide system, electric motor and with a control adapted to the system.

According to another particular embodiment of the invention, the guide units are chosen from the group consisting of ball guides, on profiled rails, of rollers, with recirculating ball pads, and precision guide rails.

According to another particular embodiment of the invention, the guide units allow to combine linear movement and rotary movement.

According to another particular embodiment of the invention, the support comprises a vibrating bowl (14) allowing the storage, distribution, and orientation of the winding segments, in particular of the pins.

More particularly, the vibrating bowl according to the invention allows to feed the device with pins automatically. This distribution system feeds and directs the pins, stored in bulk in a tank, to a motorized turntable provided with vertical storage locations for the pins, preferably 5 to 30 vertical storage locations for the winding segments, for example pins which are picked up by a planting clamp/gripper. The vibrating bowl is fitted with a chute or other means, such as a hose, which channels the fall of the pins at the arrival point of the turntable, to the vertical storage locations.

When the turntable is full, the vibrating bowl stops; the tray is emptied using the gripper. A pin arrival detector triggers the rotation of the turntable.

According to another particular embodiment of the invention, the winding segments (2) consist of or comprise elongated elements suitable for holding the article of textile during manufacture in a fixed position on the support. Winding segments consists in or comprises metal, alloy, wood, plastic, ceramic.

According to a particular embodiment of the invention, the winding segments are chosen from the group consisting of pins, pawns, solid or hollow rods.

In the latter case, glue can be applied to the internal windings of thread in contact with the body of the winding segment.

According to a particular embodiment of the invention, the winding segments are smooth or are provided with roughness. The winding segments may or may not have a head.

According to a particular embodiment of the invention, the winding segments are covered with a sleeve of rubber or another rough material or/and deformable under pressure to prevent the thread-type element from sliding out of the winding segment.

According to a particular embodiment of the invention, the winding segments are arranged at an angle of 90 to 120° relative to the surface of the support.

It is advantageous to favor an angle of 100° to 125°, preferably 110° to 120°, even more preferably 115° for each winding segment, in order to aid in the trapping of the thread and its sliding at the base of the winding segment. The wound thread is thus, by its tensioning around the winding segment, plated and brought into contact with the flat surface of the support or the convex surface obtained by the network of profiles.

The height of the winding segments is dictated by the size and complexity of the textile item to be made.

The height of the winding segments will be all greater given the number of passages (windings) on each winding segment is important. Generally the height of a winding segment, for example a pin, is from 0.5 cm to 5 cm.

The diameter of a winding segment is generally 1 to 5 mm, preferably 2, 3, or 4 mm.

According to a particular embodiment of the invention, the distance between two contiguous winding segments located on the support is between 2 mm and 1 cm, preferably this distance is 5 mm.

According to a particular embodiment of the invention, the winding segments are arranged on a part of the support provided with a jack or any other lifting system or disengaging mechanism.

According to a particular embodiment of the invention, the winding segments are placed manually on the support.

According to a particular embodiment of the invention, the winding segments are placed on the support using a means (3) provided with a clamp (11) allowing to position or remove the winding segments on the support according to the outline of a shape to be manufactured corresponding to the pattern of a textile article. Said means (3), in particular a head for planting/gripping the winding segments is optionally attached to an articulated arm controlled by a computer system.

Mecha-electronic means (5), for example stepper motors are used to move the planting/gripping head in three dimensions along the axes "X", "Y" and "Z" in a system of rectangular coordinates as well as a system of 2 angular axes alpha and beta according to a predetermined sequence and pattern.

The device according to the present invention comprises independent parts that are easily replaceable, in particular in the event of wear.

In a first configuration of use, the device of the present invention comprises a planting/gripping head (3) for placing the winding segments on the support.

The means (3), in particular the planting/gripping head, is movable in a plan which generally corresponds to an orthogonal X-Y plan. The device of the present invention further comprises a control unit configured to continuously coordinate the movements of the planting/gripping head (3) in the X-Y plan relative to the support. In the present invention, the term "control unit" is understood to mean the software integrated or connected to the weaving device.

The control unit is also configured to control movement of the planting/gripping head (3) in the Z direction and on alpha and beta rotations.

The control unit has a digital input for loading an image (the pattern) of the textile article to be manufactured.

The image (the pattern) of the textile article to be manufactured can be scanned with a LECTRA type scan or directly with a camera incorporated in the machine.

Image processing can then be performed using commercial software such as MATLAB® ("matrix laboratory") developed by The MathWorks company.

MATLAB® allows to manipulate matrices, display curves and data, implement algorithms, create user interfaces. The computerized control system also includes input acquisition and power output control interfaces, for example an Arduino® card (Mega), associated with power stages, a Twincat® (Beckhoff) or Arduino® electronic card (Mega) to control the weaving device according to the invention.

The planting/gripping head (3) of the device of the present invention further comprises an optical camera connected to the control unit allowing to scan a pattern via the control unit.

The camera also allows to monitor quality and manufacturing defects in real time and to record the directions of the segments of the thread-type element during the manufacture of a textile piece according to the invention.

The device of the present invention also comprises a distribution head for the thread-type element (4) provided with a thread-type element outlet.

The device of the present invention is designed so as to be able to substitute said distribution head (4) for said planting/gripping head (3).

In a second configuration of use, the device of the present invention comprises said distribution head (4) for winding the thread-type element around the winding segments arranged on the support.

In particular, the distribution head (4) is movable in a plan which generally corresponds to an orthogonal X-Y plan.

The device of the present invention further comprises a control unit configured to continuously coordinate the movements of the distribution head (4) in the X-Y plan relative to the support.

In the present invention, the term "control unit" is understood to mean the software integrated or connected to the weaving device.

The control unit is also configured to control the movement of the distribution head (4) in the Z direction and can optionally control the rotation of the distribution head (4) around the Z axis. The control unit has a digital input allowing to load an image (the pattern) of the textile article to be manufactured.

The distribution head is controllably raised along a "Z" axis in order to arrange the winding segments, for example on a three-dimensional support and optionally in order to sequentially form stretches and windings of the thread around the winding segments arranged on the support.

In order to mechanically or semi-automatically (with manual help for winding the thread) form each winding direction around the winding segments arranged on the support, drive motors are provided to selectively move the distribution head (4) in a predetermined pattern along the "X" and "Y" axes during the distribution of the thread-type element.

Relative vertical movement along a "Z" axis can also be performed during the formation of each winding, to allow the winding and tensioning of the strand member segments around the winding segments.

In particular, the number of windings around the winding segments and interweavings of the thread segments, and especially their directions can be programmed. These mechanical movements are preferably achieved through control signals input to the control motors and the distribution head from a CAD/CAM system. In such a system, the design of a textile article to be manufactured is initially created from computer-aided design (CAD) software known to the man skilled in the art; this software being used to convert the shape of the pattern into releasable computer data in the form of thread-type element segments and needle placement as control signals via a computer aided machine to the aforementioned drive motors.

The operator can disengage the automatic system of the device of the present invention in order to correct or reorient the manufacture of a textile article to create, for example, zones with complex gap structures by modifying the number of wounds around certain winding segments and interweaving of the thread segments, as programmed.

The thread-type element at the base of the textile article to be manufactured is preferably supplied to the distribution head (4) by a power source, such as a coil of thread-type element.

A separate mechanical drive means is provided for the upward and downward vertical movement of the distribution head (4). A drive motor supplies a rotary drive power to a drive screw.

The selected actuation of the motor rotates the screw to provide vertical up and down movement of the distribution head (4) on the plain bearing.

To this end, the motor is preferably a stepping motor, optionally at high resolution.

It should be noted, however, that different types of motors could be used for drive motors, including stepper motors, linear motors, servo motors, synchronous motors, DC motors, and fluid motors.

Referring to FIG. 1, one can observe the different motors (5*a*, 5*b*, 5*c*) serving to move the means (3-4), in particular the planting/gripping head of the winding segments (3) and the distribution head (4).

In particular, the motor (5*a*) allows the movement of at least one means (3) and/or (4) along the "X" axis, the motor (5*b*) allows the movement of at least one means (3) and/or (4) along the "Y" axis, the motor (5*c*) allows the movement of at least one means (3) and/or (4) along the "Y" axis.

The manufacture of a textile article is achieved by the successive formation of segments of a thread-type element around the winding segments forming the pattern of the textile article to be produced.

The thread-type element feed is controlled with respect to the "X", "Y" and "Z" movement of the distribution head so that the thread tension is controlled.

According to a particular embodiment of the invention, the coil of the thread-type element and its base are arranged in connection with the distribution head. According to another particular embodiment of the invention, the coil of the thread-type element rests on a base which is not integral with the device. The coil of the thread-type element can also rest on the ground.

It is understood that the weaving device according to the invention can be used in an automatic, semi-automatic or manual mode.

Another object of the present invention is also a method of manufacturing a piece of a textile article from a continuous thread element comprising:

a) a step of positioning the winding segments in an initial position on a support in order to define the outline of a shape to be manufactured corresponding to the pattern of said piece of a textile article, b) a step of winding the thread-type element around a first winding segment, c) a step of stretching the thread-type element so as to position the thread-type element around a second winding segment, and thus form a first segment of the thread-type element, d) a step of stretching the thread-type element wound around the second winding segment following either a return path to the first winding segment or a path to another winding segment and forming a second thread-type element segment, e) repeating the steps of stretching and winding the thread-type element around all the winding segments of the outline of the shape to be manufactured so as to form a third, a fourth, up to the nth segment of the thread-type element so as to obtain said piece of textile article, f) a step of removing said piece of a textile article from said support by moving the winding segments from their initial position, by any means of vertical translation, downward or upward.

Each segment of the thread-type element is reversible by nature so as to allow to modify the design formed by the tracing of the paths of the thread-type element. Once this shape has been validated, the winding of the thread-type element between two winding segments is made irreversible either by fixing (blocking) or by a closed loop (half key).

According to the present invention, the type of winding is chosen from the group consisting of a partial winding, a total winding of the open loop type (reversible), a total winding of the open loop type (made irreversible by fixing (blocking) a gluing segment), a complete winding of the blocked closed loop type (half key).

For example, one can cite the sewing segments of the buttonhole segment, slipper segment, saddle segment (with both ends of a thread, or two threads).

According to the present invention, each segment of thread-type element, positioned between two winding segments, is fixed irreversibly after validation of the course of the paths of the thread-type element on each of the winding segments, and so that the breakup of one thread segment has no impact on other thread segments.

In one embodiment of the present invention said method further comprises positioning winding segments forming an outline, within the shape of the piece of a textile article to be manufactured within the shape to be manufactured.

In another embodiment of the present invention, the step of stretching the thread-type element causes tension on the winding segment which can alter the angle of the winding segment with the support.

In another embodiment of the present invention, in step a) of the method, the positioning of the winding segments is carried out either manually or carried out by any electromagnetic or mechatronic means such as a robotic arm controlled by from an automatic or semi-automatic system.

In another embodiment of the present invention, in step a) of the method the positioning of the winding segments is defined by coordinates in an orthonormal frame. The winding segments can be located on a plan, or be contained and in reserve in this plan projecting out of the support only on demand (manually, semi or completely automatically) or move laterally on a segment of rail type comprising winding segments movable in translation.

In another embodiment of the present invention, said method comprises a step of blocking each loop formed on each winding segment after the winding step.

In another embodiment of the present invention, said method further comprises a step of blocking each thread segment performed after the step of winding the thread-type element around a winding segment. The winding step comprises forming at least a partial winding of the thread member around a winding segment.

In another embodiment of the present invention, said at least one blocking loop is formed on each winding segment after the winding step.

In another embodiment of the present invention, said blockage is formed on all the loops of the piece of a textile article to be manufactured.

In another embodiment of the present invention, said blocking of at least one loop on a winding segment is carried out by mechanical, chemical or thermal means, for example the blocking is carried out by means of a knot, a segment of sewing or weaving, a staple, thread, glue, resin, a weld, by folding a metal thread as "a staple" once each of the two legs of it passed through each of the two partial or total windings of the thread-type element.

Blocking can be accomplished by entrapment of a thread other than the single continuous thread-type element used for the manufacture of a textile piece according to the method of the present invention, forming a so-called "buttonhole" segment.

In another embodiment of the present invention, said blocking is formed on all the loops of the piece of a textile article to be manufactured using one or more mechanical, chemical or thermal means.

For example, it is obvious that welding can only be suitable for types of thermoplastic type thread. Welding can be done with or without adding material.

It consists in punctually heating the parts to be "glued" together by changing their state from solid to viscous, by heat, then to press mechanically and wait for the return to the solid state by lowering the temperature.

In another embodiment of the present invention, said method comprises a step of winding the thread on two neighboring blocking points.

This winding of the thread at two neighboring blocking points preferably comprises a blocking step by loop formed on one or both of the winding points, after the winding step.

According to the present invention, the direction of the thread-type element to form a thread-type element segment, positioned between two winding segments, is chosen randomly or planned (designed and shown in the drawing), manual, semi-automatic or programmed, in this case by means of software), said direction involving either a return path of the thread-type element between two winding segments so as to obtain a superposition of two segments between two aforementioned winding segments, or a path from the thread-type element to a winding segment other than that coming from the last path of the thread-type element so as to obtain a partial or loop winding between the new thread-type element segment with one or more existing segments.

In another embodiment of the present invention, the control unit comprises a digital input allowing to load an image (the pattern) of the textile article to be manufactured, said digitized image comprising information of color, shape, size and density of overlap of the tread-type element segments.

In another embodiment of the present invention, the loading of the scanned image into the control unit is accomplished by means of a scanning tool such as a scanner.

In another embodiment of the present invention, the digitized image is represented as a network representing segments of the thread-type element.

It is therefore understood that in order to manufacture a piece of a textile article according to the method of the present invention, the weaving device comprises a computer on which a known software in the state of the art is installed for controlling said device, in particular the various motors actuating the means (3-4) of the device. Furthermore, the computer may comprise a processing and control module connected to the weaving device.

The device can also include a set of input peripherals connected (with or without wire) to the computer, which can be manipulated by an operator in order to make the textile article by interacting with the software.

It is understood that the computer, the known software as well as the input peripherals constitute the means for creating the textile piece, and that the processing and control unit of the computer as well as the device of the present invention constitute the means of weaving.

The thread-type element can be positioned manually or automatically, around each winding segment, like a simple weave.

The thread-type element makes return paths between the winding segments of the piece of a textile article to be manufactured; each winding segment accepts up to 50 passages of the thread-type element, preferably more than 20 passages or 20 to 30 passages.

The thread-type element required for weaving can vary in quality and thickness.

In another embodiment of the present invention, the thread-type element is tensioned before it is wound around a winding segment.

The tension of the thread-type element is controlled by unwinding of at least one coil associated with a motor for driving (in rotation) said coil, which motor is associated with a brake mechanism.

In another embodiment of the present invention, the control unit contains all the characteristics of the piece of the textile to be manufactured; said characteristics correspond to

- the number of passages of the thread-type element on each winding segment,
- the total number of segments of the thread element of the piece of the textile to be manufactured
- to the directions of the segments of a thread-type element on an orthonormal axis for example,
- the number of overlays or crossings of segments of a thread-type element.

In another embodiment of the present invention, the number of overlays of thread element segments within the textile article being manufactured is tracked by an optical capture system, eg, a camera.

In another embodiment of the present invention, the method allows to obtain a piece of a textile article the areas of which was not covered by a segment of a thread element have an average surface area of 0.01 to 1 $cm^2$.

When the piece manufactured by the method of this application is a garment, the artistic approach is a major component of the manufacturing.

The operator can then use the device according to the invention in manual or semi-automatic mode to execute according to his choice

- the number of passages of the thread-type element on each winding segment,
- the directions of the segments of a thread-type element on an orthonormal axis for example,
- the number of overlays or crossings of segments of a thread-type element.

In another embodiment of the present invention, the textile article piece obtainable by said method comprises or consists in a single piece having a complex shape, the perimeter of which comprises both at least one curve and one straight line.

In another embodiment of the present invention, the textile article piece obtainable by said method comprises or consists of a single piece of rounded or convex shape, forming a three-dimensional article.

In another embodiment of the present invention, the piece of textile article obtainable by said method comprises or consists of at least one thickness, that is to say of a single superposition of thread element.

According to the present invention, the loops forming the periphery of each piece of textile article obtainable by said method are linked together by buttonhole stitches or any other stitching point known to the man skilled in the art.

In another embodiment of the present invention, the piece of textile article obtainable by said method is assembled into a garment, a fabric for coating or covering an object, industrial furniture such as a automobile seat, a cloakroom accessory, a shoe, a component of technical equipment such as an explosion-proof tank, a propeller blade of a wind turbine for example.

In another embodiment of the present invention, several pieces of a textile article which can be obtained by a method according to the invention, are assembled into a garment, a fabric for coating or covering an object, industrial furniture, a cloakroom accessory, a shoe, or a component of technical equipment.

Said assembly of several pieces of textile article can be carried out by means of one or more buttonhole stitches or any other stitching allowing the pieces of textile article to be assembled edge to edge without overlapping.

The present invention also relates to an assembly of several pieces of a textile article which can be obtained by a method according to the invention, characterized in that said assembly is carried out by means of one or more buttonhole stitches or any other stitch allowing to assemble the pieces of textile article edge to edge without overlapping, as shown in FIG. 7.

The present invention also relates to a made-to-measure garment comprising several pieces of textile article obtainable by a method according to the invention, characterized in that said pieces of textile article are assembled by means of one or more buttonhole stitches or any other stitching point allowing to assemble the pieces of textile article edge to edge without overlapping.

A made-to-measure garment corresponds to a garment the body measurements of which have been digitized beforehand in order to be processed by computer-aided design (CAD) software known to the man skilled in the art.

Examples of embodiments of the invention are described in the following, without limitation in relation to the accompanying figures which are intended above all to illustrate the principles of the invention.

FIG. 4 is a diagram showing the arrangement of winding segments and multiple thread segments wound x times (18 times in FIG. 4*a*) on a single winding segment.

Figure 1:
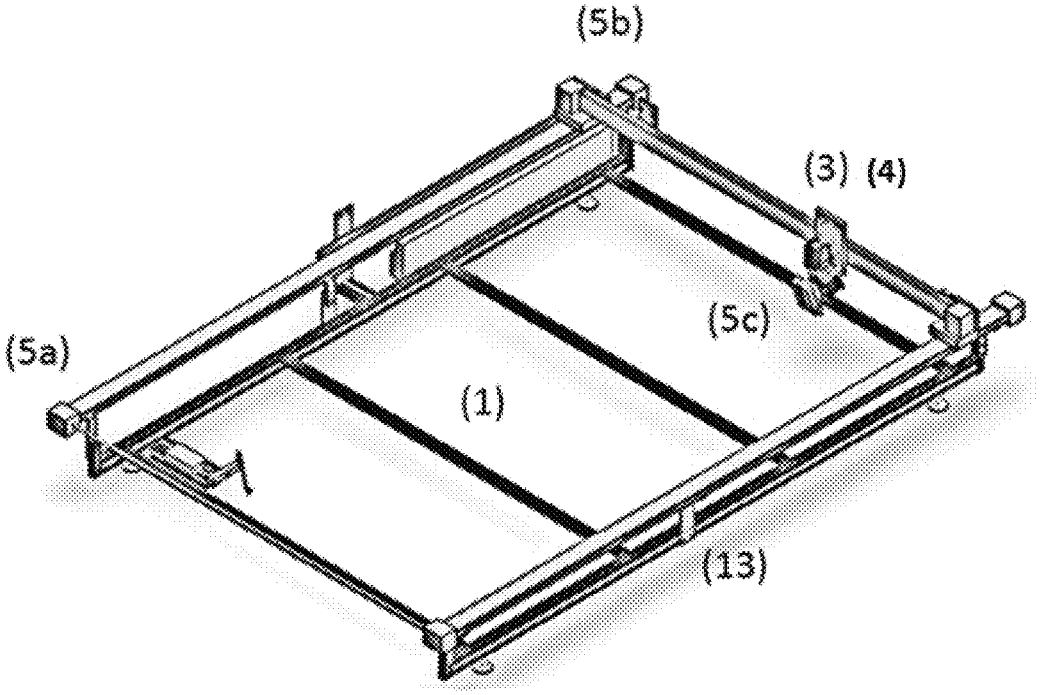
FIG. 1 is a perspective view showing the device for placing the winding segments on the carrier.
Figure 2:
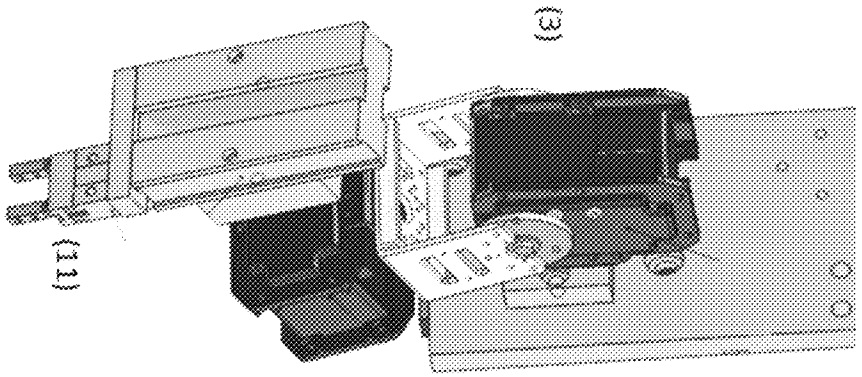
FIG. 2 is a general view of the planting/gripping head (3) of the winding segments.
Figure 3:
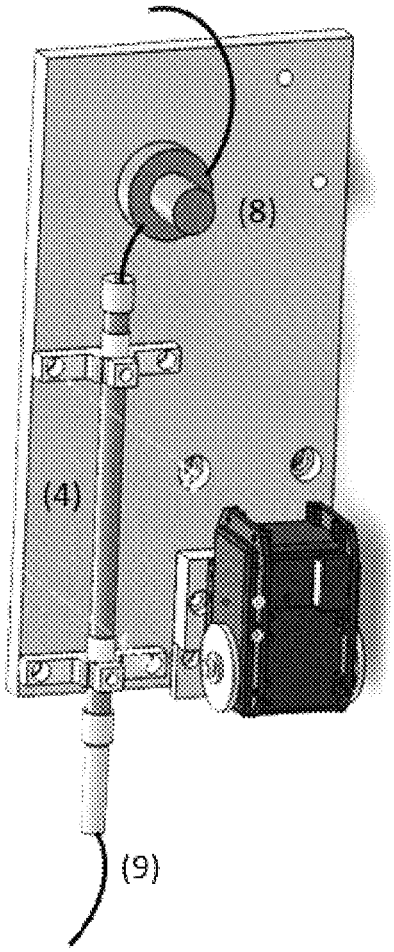
FIG. 3 is a general view of the distribution head (4).
Figures 4A, 4B, 4C:
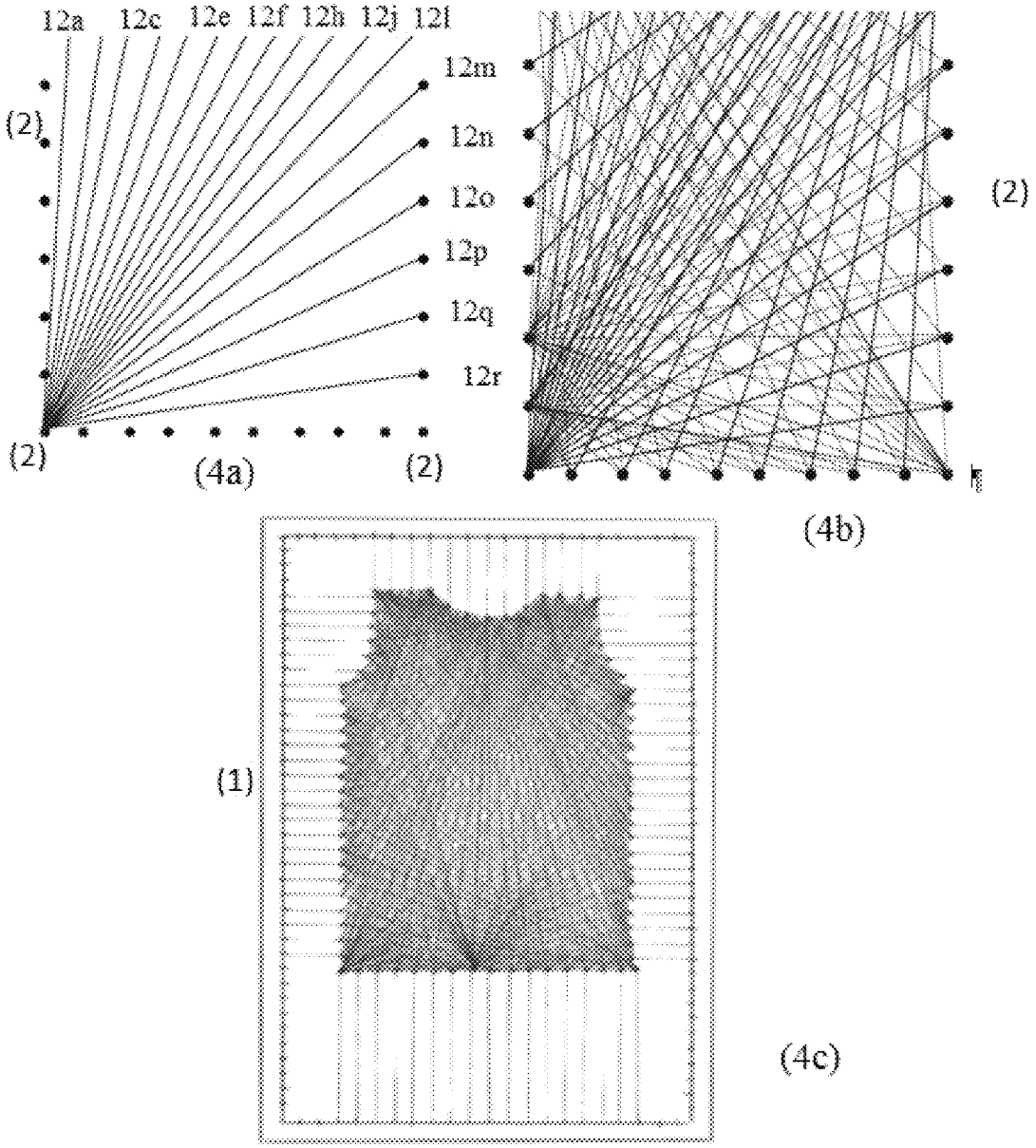
FIG. 4*b* shows the textile being manufactured.

FIG. 4*c* shows a piece of a textile article obtained or being obtained by the method.

Figure 5A:
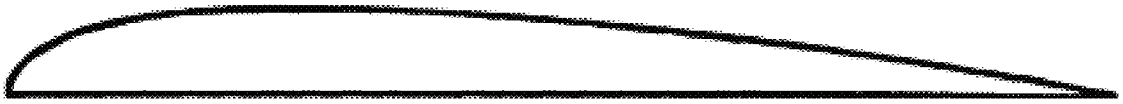
Figure 5B:
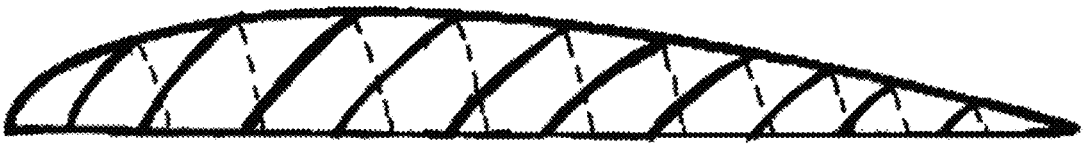
Figure 5C:
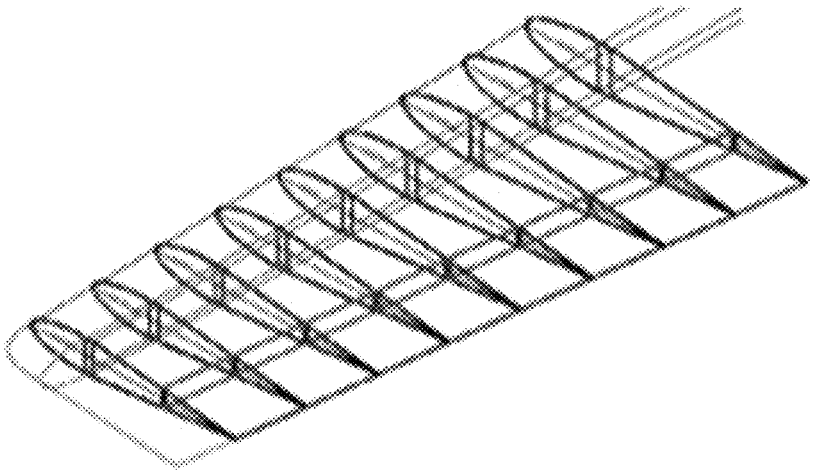

FIG. 5 shows a plan profile (in piece) (5*a*), a 3D shape made from a profile (5*b*) and a repetition of profiles forming a wing (5*c*).

Figure 6A:
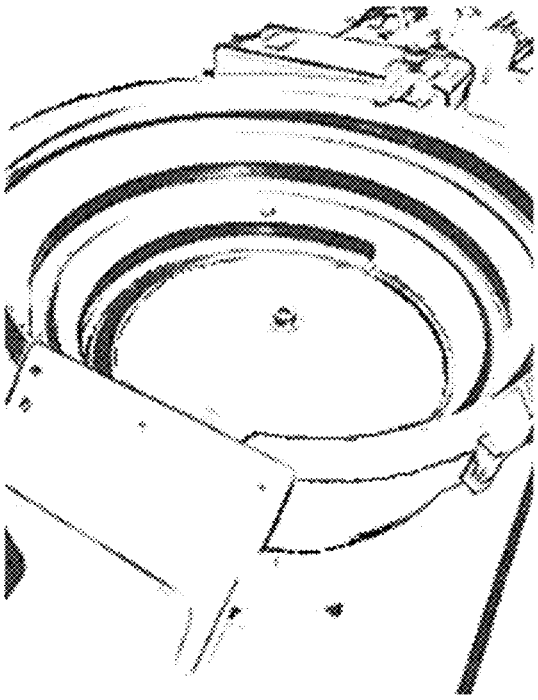
Figure 6B:
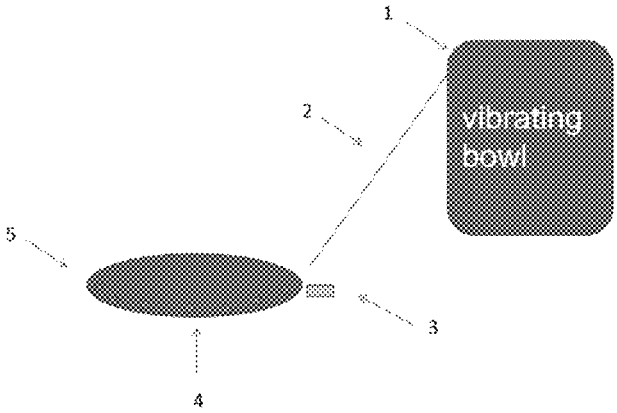

FIG. 6A shows a photograph of a vibrating bowl; FIG. 6B is a diagram of the principle of operation of the derating of the winding segments (pins); step 1 represents the exit point one by one of the pins, facing upwards; step 2 represents the descent of the pins by gravity; step 3 represents the detection of arrival of pins; step 4 represents the rotation or the stop of the turntable according to its state of loading in pins; step 5 represents the unloading of the tray by the gripper of the device of the invention.

Referring to FIG. 4*c*, there is schematically shown the manufacture of a textile article piece according to the method of the present invention.

Figure 7A:
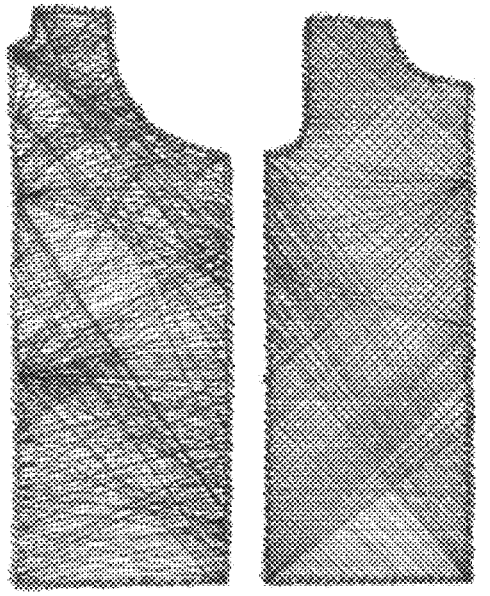

FIG. 7A shows the finishing of two pieces of textile article obtained according to the invention using a buttonhole stitch.

Figure 7B:
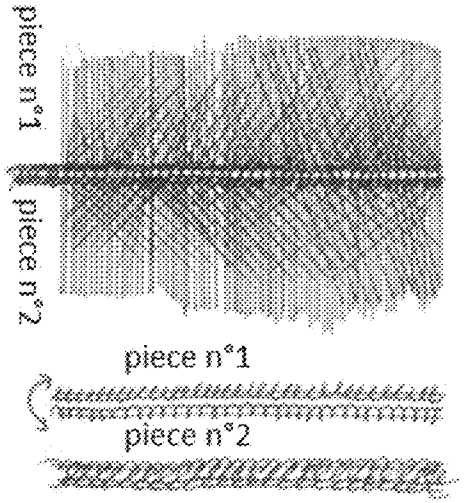

FIG. 7B shows the assembly of two pieces of textile obtained according to the invention.

The assembly shows 3 buttonhole stitches piece by piece.

Figure 7C:
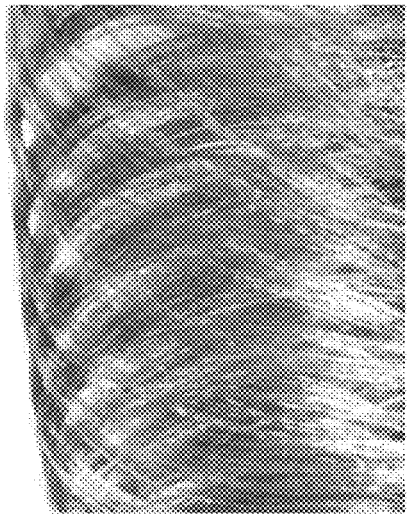

FIG. 7C shows a close-up photograph of the finishing of a piece of a textile article according to the invention.

Said piece of a textile article is formed by interweaving of a continuous thread-type element, said continuous thread-type element forming segments of a thread-type element around the winding segments disposed on a support. The winding segments are arranged on the support so as to form the outline of the shape to be woven.

The nuancing of the crossing of the segments of a thread-type element is defined either by the operator or by a computer program. The weaving pattern is achieved by defining relative weaving characteristics

- the number of passages of the thread-type element on each winding segment,
- the total number of segments of the thread element of the piece of the textile to be manufactured
- to the directions of the segments of a thread-type element on an orthonormal axis for example,
- the number of overlays or crossings of segments of a thread-type element.

Preferably, the weaving directions, that is to say the orientations of the segments of the thread-type element around the winding segments can be predefined in an image generated of the fabric to be woven by means of a specific application of the known software of MATLAB® type.

In other examples, the positions of the thread-type element segments are recorded by the control system via a camera type (5MP OmniVision® OV5640 without distortion).

This embodiment is particularly advantageous when the operator wishes to create several identical or substantially identical pieces of textile, that is to say comprising the same weaving directions.

The previously defined weaving characteristics can be converted into computer data. Modifications may be provided in order to define variations in the orientation of the segments of the thread element in order to obtain a piece of textile having the same shape or a substantially identical shape but the aesthetic appearance and/or weaving characteristics of which is/are different.

In the exemplary embodiment of FIG. 4, the principle of the formation of the segments of a thread-type element which is used in the weaving method of the present invention has been illustrated.

A surface of the support has been shown in FIG. 4; said surface has 7 winding segments on a first left vertical axis, 7 other winding segments on a second vertical right axis and 10 winding segments on a "lower" horizontal axis.

FIG. 4 does not show the winding segments on an "upper" horizontal axis.

In the present application, the expressions "lower", "upper", will be understood as referring to a displacement along the "X" axis.

Likewise, the terms "left" and "right" will be understood to refer to displacement along the "Y" axis.

Referring to FIG. 4, it is understood that a succession of steps of winding the thread-type element is carried out around a first winding segment, on the original position at the intersection of the vertical left axis and the "lower" horizontal axis.

This figure shows the formation of 18 thread-type element segments (12*a*-12*r*), all wound around a single winding segment.

These 18 thread-type element segments are formed in a return path to the first winding segment.

The FIG. 4*b* represents a weaving step in which a repetition of the steps of stretching and winding the thread-type element are carried out around all the winding segments of the shape to be manufactured so as to form the thread-type element segments which cross.

The thickness of the textile piece to be manufactured depends on the number of passages made on each winding segment and the thickness of the thread-type element.

FIG. 4*c* shows a piece of a textile article during manufacture.

The loops are always attached to the winding segments of the weaving device according to the invention.

The invention claimed is:

1. A weaving device for the manufacture of a piece of a textile article from a continuous thread-type element, said device comprising:

a support, winding segments, a removable or retractable winding segment planting/gripping head for positioning or removing winding segments on the support according to the outline of a shape to be manufactured corresponding to the pattern of the textile article, a removable or retractable distribution head for delivering and winding the thread-type element around the winding segments, a supply of thread-type element, stepper motors for moving said removable or retractable winding segment planting/gripping head and removable or retractable distribution head in three dimensions along the axes "X", "Y" and "Z" in a system of rectangular coordinates as well as on 2 axes of alpha and beta rotations in an angular system according to a predetermined sequence and pattern, and a control system comprising a software controlling the movement of said removable or retractable winding segment planting/gripping head and removable or retractable distribution head, wherein the winding segments are arranged on the support with an angle of 100 to 125° relative to the surface of the support.

2. The device for the manufacture of a piece of a textile article according to claim 1, wherein the device further comprises a tension block of the thread-type element.

3. The device for the manufacture of a piece of a textile article according to claim 1, wherein the winding segments are chosen from the group consisting of pins, pawns, solid or hollow rods.

4. The device for the manufacture of a piece of a textile article according to claim 1, wherein the winding segments are smooth or provided with roughness.

5. The device for the manufacture of a piece of a textile article according to claim 4, wherein the winding segments are covered with a sleeve of rubber or other rough material and/or deformable under pressure to prevent the thread-type element from sliding out of the winding segment.

6. The device for the manufacture of a piece of a textile article according to claim 1, wherein the support:

is flat, or is flat and comprises one or more non-flat zone(s), or consists in one or more non-flat zone(s).

7. The device for the manufacture of a piece of a textile article according to claim 6, wherein the one or more non-flat zones are convex.

8. The device for the manufacture of a piece of a textile article according to claim 1, further comprising a base for one or more coils of a thread-type element.

9. A method of manufacturing an assembly comprising several pieces of a textile article from a continuous thread-type element comprising:

a) a step of positioning the winding segments in an initial position on a support in order to define the outline of a shape to be manufactured corresponding to the pattern of said piece of a textile article, b) a step of winding the thread-type element around a first winding segment, c) a step of stretching the thread-type element so as to position the thread-type element around a second winding segment, and thus form a first segment of the thread-type element, d) a step of stretching the thread-type element positioned around the second winding segment following either a return path to the first winding segment or a path to another winding segment and forming a second thread-type element segment, e) repeating the steps of stretching and winding the thread-type element around all the winding segments of the outline of the shape to be manufactured so as to form a third, a fourth, up to the nth segment of the thread-type element so as to obtain said piece of textile article, f) a step of removing said piece of a textile article manufactured from said support by moving the winding segments from their initial position, by vertical translation, downward or upward, and g) a step of assembling several pieces of textile article wherein each loop forming the periphery of each piece of textile article are linked together by buttonhole stitches, said method being implemented using the weaving device according to claim 1.

10. The method of manufacturing an assembly comprising several pieces of a textile article according to claim 9, wherein the winding of the thread-type element around all the winding segments is chosen from the group consisting of a partial winding, a total winding of the reversible or irreversible open loop type, and a complete winding of the blocked closed loop type.

11. The method of manufacturing an assembly comprising several pieces of a textile article according to claim 9, further comprising a step of blocking each loop formed on each winding segment after the winding step.

12. The method of manufacturing an assembly comprising several pieces of a textile article according to claim 9, wherein each segment of the thread-type element, positioned between two winding segments, is fixed irreversibly after validation of the course of the paths of the thread-type element on each of the winding segments.

13. The method of manufacturing an assembly comprising several pieces of a textile article according to claim 9, wherein a locking of each loop on a winding segment is carried out by mechanical, chemical or thermal means.

14. The method of manufacturing an assembly comprising several pieces of a textile article according to claim 9, wherein a direction of the thread-type element to form a thread-type element segment, positioned between two winding segments, is chosen randomly or planned, manual, semi-automatic or programmed, said direction involving either a return path of the thread-type element between two winding segments so as to obtain a superposition 4 between two aforesaid winding segments, or a path of the thread-type element to another winding segment than that coming from the last path of the thread-type element so as to obtain a partial or loop winding between the new segment of the thread-type element with one or more existing segment(s).

* * * * *